US005971770A

United States Patent [19]

Richmond

[11] Patent Number: 5,971,770

[45] Date of Patent: Oct. 26, 1999

[54] COAXIAL CONNECTOR WITH BELLOWS SPRING PORTION OR RAISED BUMP

[75] Inventor: Mark A. Richmond, Batavia, Ill.

[73] Assignee: Labinal Components and Systems, Inc., Lombard, Ill.

[21] Appl. No.: 08/965,070

[22] Filed: Nov. 5, 1997

[51] Int. Cl.[6] ..... H01R 9/09

[52] U.S. Cl. ..... 439/63

[58] Field of Search ..... 439/63; 33/55

[56] References Cited

U.S. PATENT DOCUMENTS

| | | | |
|---|---|---|---|
| 23,447 | 4/1859 | Christian et al. . | |
| 701,112 | 5/1902 | Watkins . | |
| 2,238,834 | 4/1941 | Travers | 173/361 |
| 3,109,997 | 11/1963 | Giger et al. | 333/8 |
| 3,179,912 | 4/1965 | Huber et al. | 339/17 |
| 3,206,540 | 9/1965 | Cohen | 174/89 |
| 3,293,592 | 12/1966 | Blonder | 339/177 |
| 3,335,388 | 8/1967 | Karol | 339/18 |
| 3,384,703 | 5/1968 | Forney, Jr. et al. | 174/75 |
| 3,406,376 | 10/1968 | Varrin | 339/258 |
| 3,426,311 | 2/1969 | Gifford | 339/17 |
| 3,437,960 | 4/1969 | Ziegler, Jr. | 333/97 |
| 3,525,973 | 8/1970 | Kipnes | 339/177 |
| 3,539,966 | 11/1970 | Logan | 339/17 |
| 3,541,495 | 11/1970 | Ellis et al. | 339/177 |
| 3,555,497 | 1/1971 | Watanabe | 339/258 |
| 3,594,708 | 7/1971 | LaLonde | 339/176 |
| 3,662,318 | 5/1972 | Decuyper | 339/17 R |
| 3,745,514 | 7/1973 | Brishka | 339/91 R |
| 3,781,763 | 12/1973 | Feeser et al. | 339/91 P |
| 3,786,401 | 1/1974 | Jones et al. | 339/258 R |
| 3,825,874 | 7/1974 | Peverill | 339/14 R |
| 3,828,305 | 8/1974 | Hogendobler | 339/177 R |
| 3,848,164 | 11/1974 | Otte | 317/256 |
| 3,858,156 | 12/1974 | Zarro | 439/221 |
| 3,871,735 | 3/1975 | Herrmann, Jr. | 339/177 R |
| 3,874,769 | 4/1975 | Simon | 339/217 S |
| 3,879,103 | 4/1975 | Peltola et al. | 339/177 R |

(List continued on next page.)

FOREIGN PATENT DOCUMENTS

| | | | |
|---|---|---|---|
| B46120/85 | 2/1986 | Australia | H05K 1/18 |
| 0 090 538 | 10/1983 | European Pat. Off. | H01R 17/12 |
| 0651467A2 | 5/1995 | European Pat. Off. | H01R 17/12 |
| 0751592A1 | 2/1997 | European Pat. Off. | H01R 17/12 |
| 1157274 | 3/1958 | France . | |
| 21459 | 6/1961 | Germany . | |
| 2 335 361 | 2/1974 | Germany . | |
| 1 480 724 | 7/1977 | United Kingdom | H01R 13/12 |
| 2274356A | 7/1994 | United Kingdom | H01R 4/00 |

OTHER PUBLICATIONS

IBM Technical Disclosure Bulletin, vol. 33, No. 4, pp. 216–218, Sep. 1990.

6 photographs of a coaxial connector with the name "AMP" available to the applicant in approximately May 1994.

9 pages of product information on BNC connectors from AMP Incorporated one page undated and other pages dated 1988 or 1991.

Front and rear cover pages and pp. 202–209 from catalog by M/A–COM Inc., Interconnect Division, Waltham, MA, copyright 1994.

*Primary Examiner*—Steven L. Stephan
*Assistant Examiner*—Michael C. Zarroli
*Attorney, Agent, or Firm*—Leydig, Voit & Mayer, Ltd.

[57] ABSTRACT

A coaxial connector is provided which can be used in cable systems which transmit telephone and internet service in addition to traditional cable television service. The coaxial connector comprises a housing which can consist of one or several components having a central bore therethrough and a one or multiple piece insulator arranged in the central bore in the housing. The coaxial connector also includes a female center contact member which is arranged in the hollow interior of the insulator. The female contact member comprises an outer surface which defines an open mating end which is adapted to receive the center conductor pin of a mating male connector and includes a pair of double bellows spring portions which extend inwardly from the outer surface. A pair of raised bumps are arranged on the contact surface of each double bellows spring portion in order to focus the contact force provided by the double bellows spring portions.

44 Claims, 17 Drawing Sheets

U.S. PATENT DOCUMENTS

| | | | |
|---|---|---|---|
| 3,910,665 | 10/1975 | Stull | 339/17 C |
| 3,915,535 | 10/1975 | O'Keefe et al. | 339/17 C |
| 4,002,400 | 1/1977 | Evans | 339/258 R |
| 4,012,105 | 3/1977 | Biddle | 339/177 R |
| 4,119,359 | 10/1978 | Schultz | 339/128 |
| 4,125,308 | 11/1978 | Schilling | 339/17 LC |
| 4,165,911 | 8/1979 | Laudig | 339/80 C |
| 4,230,385 | 10/1980 | Ammon et al. | 339/17 R |
| 4,231,629 | 11/1980 | Kirby | 339/17 M |
| 4,280,749 | 7/1981 | Hemmer | 339/177 R |
| 4,326,769 | 4/1982 | Dorsey et al. | 339/177 E |
| 4,360,244 | 11/1982 | Forney, Jr. et al. | 339/177 R |
| 4,374,606 | 2/1983 | Lathrop | 339/177 R |
| 4,377,320 | 3/1983 | Lathrop et al. | 339/177 R |
| 4,396,242 | 8/1983 | Kurano et al. | 339/14 R |
| 4,412,717 | 11/1983 | Monroe | 339/177 R |
| 4,451,107 | 5/1984 | Dola et al. | 339/143 R |
| 4,453,796 | 6/1984 | Monroe | 339/177 R |
| 4,502,749 | 3/1985 | Forney, Jr. et al. | 339/177 R |
| 4,519,665 | 5/1985 | Althouse et al. | 339/147 R |
| 4,548,453 | 10/1985 | Mummey et al. | 339/17 C |
| 4,550,972 | 11/1985 | Romak | 339/256 R |
| 4,556,265 | 12/1985 | Cunningham | 339/17 LC |
| 4,569,567 | 2/1986 | Zucchini | 339/154 A |
| 4,603,926 | 8/1986 | Nesbit et al. | 339/17 C |
| 4,645,288 | 2/1987 | Stursa | 339/177 R |
| 4,659,156 | 4/1987 | Johnescu et al. | 339/17 C |
| 4,664,464 | 5/1987 | Hutter et al. | 339/103 R |
| 4,664,467 | 5/1987 | Tengler et al. | 339/177 R |
| 4,669,805 | 6/1987 | Kosugi et al. | 439/581 |
| 4,684,200 | 8/1987 | Capp | 439/387 |
| 4,707,040 | 11/1987 | Hansel, III | 439/510 |
| 4,710,138 | 12/1987 | Bradley et al. | 439/581 |
| 4,718,854 | 1/1988 | Capp et al. | 439/63 |
| 4,734,043 | 3/1988 | Emert et al. | 439/65 |
| 4,737,111 | 4/1988 | Minar et al. | 439/63 |
| 4,743,205 | 5/1988 | Mitani et al. | 439/78 |
| 4,795,352 | 1/1989 | Capp et al. | 439/63 |
| 4,846,719 | 7/1989 | Iwashita | 439/63 |
| 4,846,731 | 7/1989 | Alwine | 439/651 |
| 4,875,865 | 10/1989 | Demler, Jr. et al. | 439/101 |
| 4,887,979 | 12/1989 | Jacobs | 439/578 |
| 4,909,746 | 3/1990 | Scholz | 439/82 |
| 4,941,831 | 7/1990 | Tengler et al. | 439/63 |
| 4,946,392 | 8/1990 | Kobler et al. | 439/63 |
| 4,964,805 | 10/1990 | Gabany | 439/63 |
| 4,964,814 | 10/1990 | Tengler et al. | 439/607 |
| 4,969,259 | 11/1990 | Macek et al. | 29/845 |
| 4,975,066 | 12/1990 | Sucheski et al. | 439/63 |
| 4,990,104 | 2/1991 | Schieferly | 439/578 |
| 4,990,105 | 2/1991 | Karlovich | 439/578 |
| 4,996,478 | 2/1991 | Pope | 324/158 P |
| 5,046,952 | 9/1991 | Cohen et al. | 439/63 |
| 5,055,068 | 10/1991 | Machura et al. | 439/581 |
| 5,062,811 | 11/1991 | Hackman | 439/620 |
| 5,078,619 | 1/1992 | Whittle et al. | 439/578 |
| 5,088,937 | 2/1992 | Gabany | 439/581 |
| 5,145,408 | 9/1992 | Houtteman et al. | 439/581 |
| 5,180,315 | 1/1993 | Nagashima | 439/581 |
| 5,184,965 | 2/1993 | Myschik et al. | 439/578 |
| 5,190,474 | 3/1993 | Ginet | 439/581 |
| 5,194,020 | 3/1993 | Voltz | 439/579 |
| 5,215,470 | 6/1993 | Henry et al. | 439/63 |
| 5,219,299 | 6/1993 | Wang | 439/188 |
| 5,226,838 | 7/1993 | Hsu | 439/582 |
| 5,244,412 | 9/1993 | Hatch et al. | 439/567 |
| 5,277,590 | 1/1994 | Thomas et al. | 439/20 |
| 5,334,050 | 8/1994 | Andrews | 439/579 |
| 5,404,117 | 4/1995 | Walz | 333/34 |
| 5,437,562 | 8/1995 | Michael | 439/581 |
| 5,441,424 | 8/1995 | Morlion et al. | 439/581 |
| 5,516,294 | 5/1996 | Andrews et al. | 439/63 |
| 5,532,659 | 7/1996 | Dodart | 333/260 |
| 5,540,603 | 7/1996 | Fujiwara | 439/851 |
| 5,550,521 | 8/1996 | Bernaud et al. | 333/260 |
| 5,562,501 | 10/1996 | Kinoshita et al. | 439/852 |
| 5,563,562 | 10/1996 | Szwec | 333/260 |
| 5,645,454 | 7/1997 | Kosmala | 439/675 |
| 5,730,621 | 3/1998 | Wang | 439/541.5 |
| 5,807,117 | 9/1998 | Kempf et al. | 439/63 |

COAXIAL CONNECTOR WITH BELLOWS SPRING PORTION OR RAISED BUMP

FIELD OF THE INVENTION

This invention generally relates to a coaxial connector and, more particularly, to a coaxial connector which can be used in systems which transmit voice, data and video signals through the same coaxial cable.

BACKGROUND OF THE INVENTION

As a result of deregulation in the telecommunication industry, many cable television providers are developing systems which will enable them to provide telephone and internet services, in addition to traditional cable television services, over the same coaxial cable. However, these new cable systems will require coaxial connectors which have significantly better performance characteristics than the connectors which are presently used in cable systems which only pass video signals.

Coaxial connectors which are presently used in the cable television industry are sometimes referred to as "F" connectors. These coaxial connectors were designed to be able to pass video signals at a relatively low cost. The male coaxial connectors which are commercially available typically have either crimped or soldered center wire pins or use the center conductor or wire of the coaxial cable as the center contact. The commercially available female coaxial connectors, sometimes referred to as "ports", typically use a variety of screw-machined or stamped contacts.

Since they were designed to only handle video signals, the coaxial connectors presently used in the cable television industry have poor electrical performance. Specifically, current coaxial connectors have unacceptably high signal loss, at the significantly higher bandwidth requirements, e.g. data transmissions speeds of up to 1 GHZ, that will be associated with the new cable systems which will transmit video, voice and data signals. Accordingly, new coaxial connectors will have to be provided for these new cable systems which can mate with existing coaxial cables and also provide reliable long-term connections and superior electrical performance even at broadband frequencies.

OBJECTS OF THE INVENTION

Accordingly, in view of the foregoing, it is a general object of the present invention to provide a coaxial connector which can be used in cable systems in which voice, data and video signals are transmitted through the same coaxial cable.

Another general object of the present invention is to provide a coaxial connector which is very reliable and, as a result, has much lower maintenance costs.

A related object of the present invention is to provide a coaxial connector which has superior electrical performance compared to known coaxial connectors, including low signal loss, at broadband frequencies.

Another related object of the present invention is to provide a reliable long term electrical connection to the center conductor which prevents oxidization, corrosion and corrosion by-products at the point of connection which will degrade the signal.

Moreover, it is an object of the present invention to provide a coaxial connector which matches the characteristic impedance of the cable transmission system.

Another object of the present invention is to provide a coaxial connector which provides a very high contact force but requires relatively small insertion and withdrawal forces.

A further related object of the present invention is to provide a coaxial connector which can mate and provide a reliable long term connection with center conductors of different diameters. In addition, it is an object of the present invention to enable the coaxial connector to mate reliably with a relatively small diameter wire after having mated with a relatively large diameter wire.

Other objects and advantages of the invention will be more readily apparent upon reading the following description of the invention and upon reference to the accompanying drawings.

SUMMARY OF THE INVENTION

A coaxial connector is provided which offers superior electrical performance at increased bandwidths as compared to conventional coaxial connectors. This superior performance enables the coaxial connector to be used in cable systems which provide telephone and internet services along with conventional cable television service. The coaxial connector generally comprises a housing having a generally cylindrical central bore therethrough and a one or multiple piece hollow cylindrical insulator arranged in the central bore of the housing.

The coaxial connector also includes a female center contact member which is arranged in the central bore of the insulator. The female contact member has a unique configuration which generally comprises a cylindrical outer surface which defines an open mating end for receiving the center conductor pin of a mating male connector and includes two double bellows spring portions which extend inwardly from the outer surface on opposite sides of the cylinder. Each of the double bellows spring portions include a bowed portion and a bent back portion which together define a three-piece spring that provides a high contact force but requires relatively low insertion and withdrawal forces. In order to concentrate or focus the force provided by the double bellows spring portions, a pair of raised bumps are arranged on the apex of each respective double bellows spring portion. The concentration of the contact force ensures a gas tight connection to the center conductor pin which provides superior electrical performance over the long term.

In addition to providing superior electrical performance, the unique female center contact member provides sufficient deflection without stress relaxation thereby enabling the coaxial connector to mate with male connectors having center conductor pins of different diameters. Moreover, the shape of the center female contact member, in conjunction with the shape of the insulators and housing, helps the connector match the characteristic impedance of the coaxial cable.

While the invention will be described and disclosed in connection with certain embodiments and procedures, it is not intended to limit the invention to those specific embodiments. Rather it is intended to cover all such embodiments and modifications as fall within the spirit and scope of the invention.

DETAILED DESCRIPTION OF THE EMBODIMENTS

One embodiment of a coaxial connector 10 constructed in accordance with the teachings of the present invention is illustrated in FIGS. 1–13. As will be described in detail below, the coaxial connector of the present invention offers superior electrical performance as compared to conventional coaxial connectors, including low signal loss, even at broadband frequencies (e.g., up to 1 GHZ). This enables the connector to be used in cable systems which can transmit video, voice and data signals through the same coaxial cable. In addition, the coaxial connector of the present invention is able to mate with existing coaxial cable center conductors having a variety of diameters and provides a reliable long term electrical connection without signal degradation. This highly reliable connection will reduce system downtime and lower maintenance costs.

Figure 1:
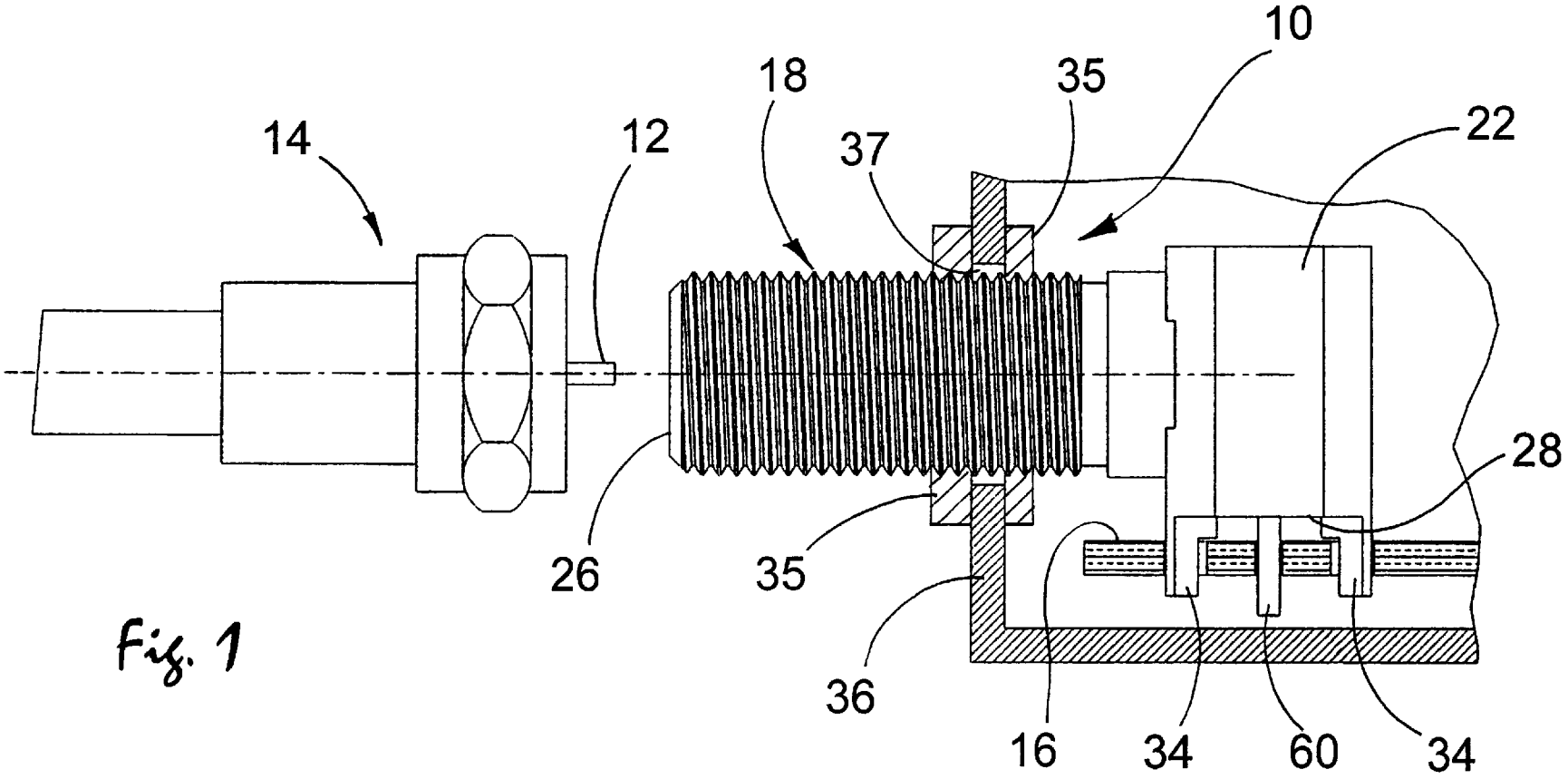
FIG. 1 is a side view of one embodiment of a coaxial connector constructed in accordance with the teachings of the present invention and a mating connector.

As shown in FIG. 1, the coaxial connector 10 is a female or F-port connector which is designed to mate, i.e. mechanically and electrically engage, the center conductor pin 12 of a complementary male coaxial connector 14 and electrically connect it to an electrical device or component such as a printed circuit board 16. The coaxial connector 10 generally comprises a front housing 18, a front insulator 20, a base housing 22, a base insulator 24 and a female center contact member 30 as best shown in the exploded view of FIG. 2. While the structure and function of the various components will be described in detail primarily in connection with the embodiment shown in FIGS. 1–13, the various other embodiments of the coaxial connector of the present invention, which are described below, utilize primarily the same basic components. It will be appreciated that the teachings of the present invention and, in particular, the unique center contact member 30 which is employed, can be applied to female coaxial connectors having any number of different configurations.

Figure 2:
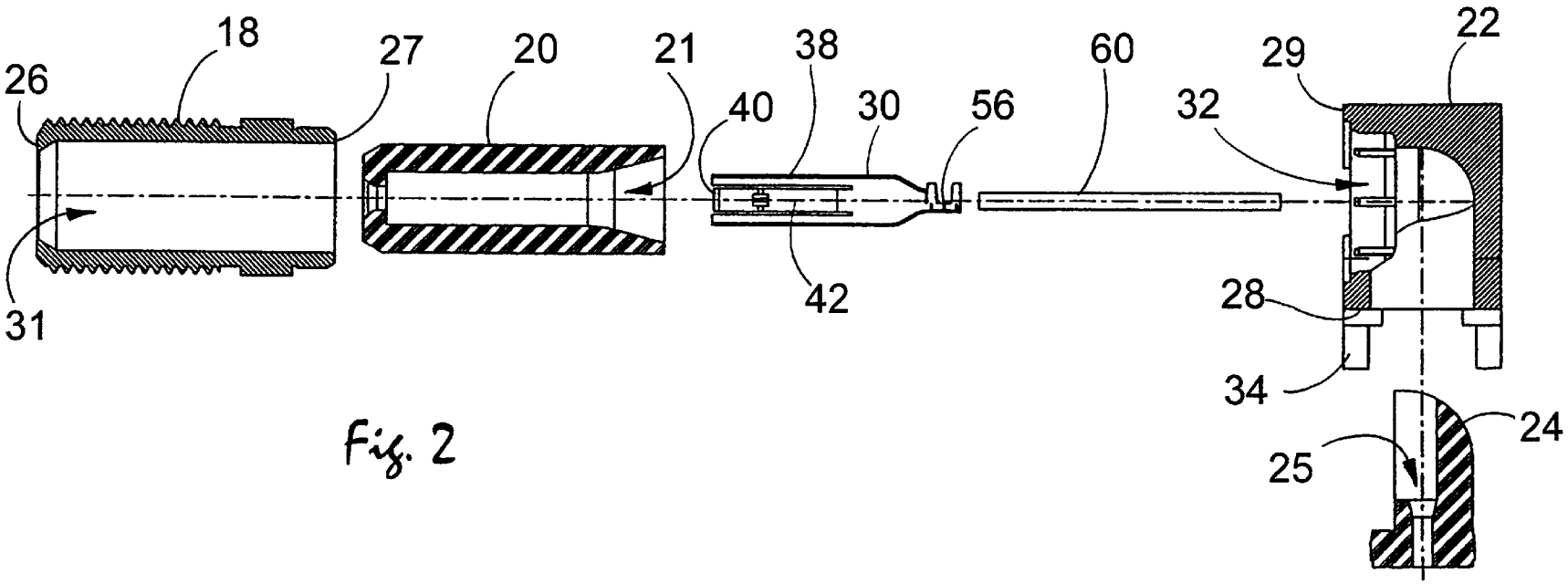
FIG. 2 is an exploded view of the coaxial connector of FIG. 1.
Figure 3:
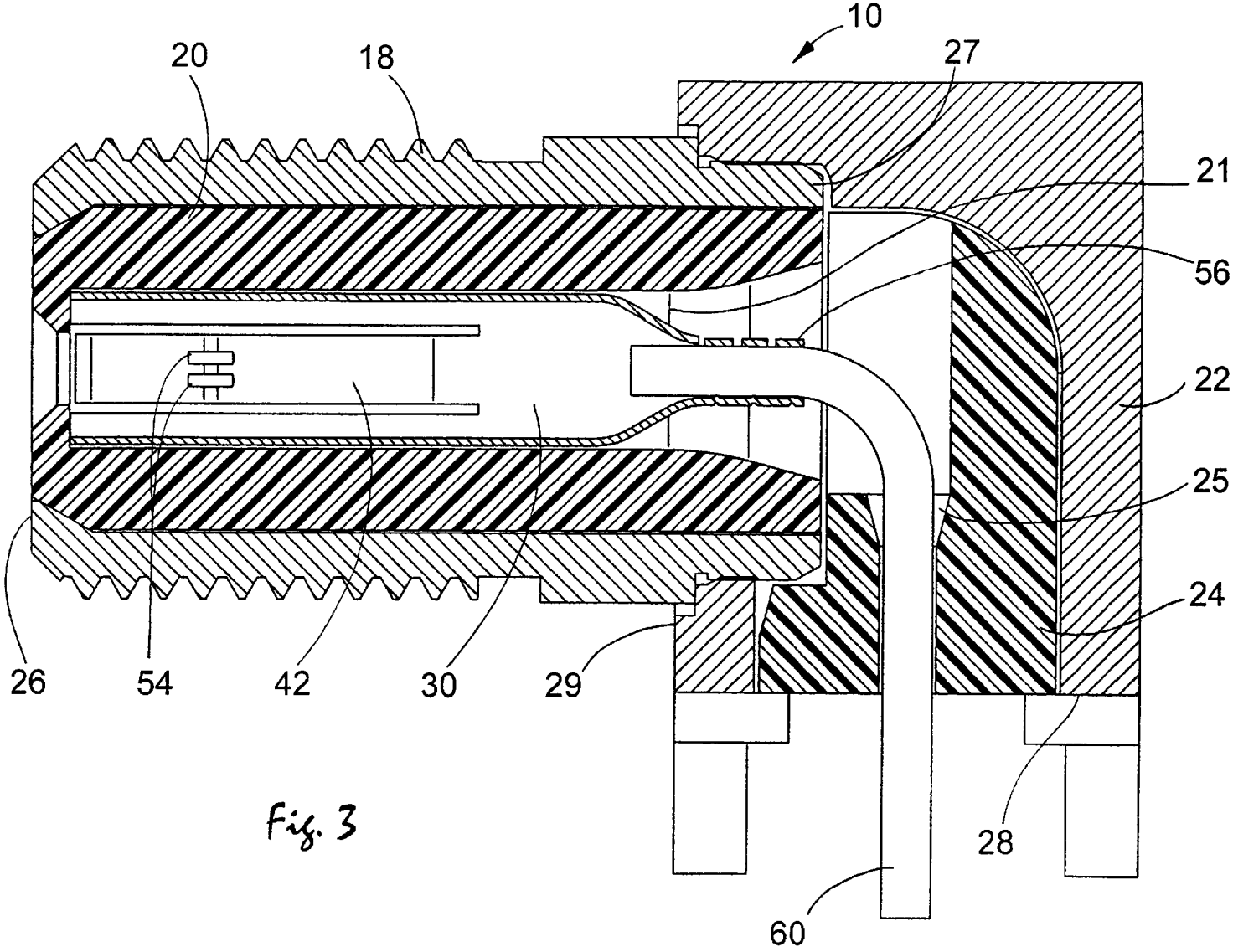
FIG. 3 is a side sectional view of the coaxial connector of FIG. 1.

In the embodiment shown in FIGS. 1–13, the front housing 18 has a generally hollow cylindrical configuration with open front mating end 26 and rear end 27 as best shown in FIGS. 2–3. A portion of the circumferential surface of the front housing 18 is threaded such that it can engage complementary threads which are provided on the mating male coaxial connector 14 when the connectors are joined together. The rear end 27 of the front housing 10 engages the front end 29 of the base housing 22. In the embodiment shown in FIGS. 1–13, the coaxial connector 10 of the present invention is configured as a right angle connector. The base housing 22 has a central cylindrical shaped bore 32 which extends along a generally right angle shaped path from an opening in the lower, terminating or mounting end 28 of the base housing to an opening in the front end 29 of the base housing. The base housing 22 also includes integral grounding legs 34 which in the illustrated embodiment can engage complementary holes in the circuit board 16, thereby establishing a ground through the coaxial connector 10. The ground legs 34 may be secured to the circuit board 16 by solder or some other suitable means.

FIG. 1 illustrates one potential installation arrangement for the right angle coaxial connector 10 of FIGS. 1–13. Specifically, the right angle coaxial connector 10 may be installed in an equipment housing 36 with the base housing 22 disposed inside the equipment housing 36 along with the circuit board 16. A portion of the front housing 18 extends outwardly through an opening 37 in the equipment housing such that the mating end 26 of the front housing is exposed so it can mate with the complementary male coaxial connector 14. The connector 10 may be secured to the housing 36 by threading the opening 37 and/or one or more nuts 35 may be provided on the threaded portion of the front housing 18 on one or both sides of the opening 37 as shown in FIG. 1.

As shown in FIGS. 2 and 3, a front insulator 20 is disposed inside the hollow bore 31 of the front housing 18. Like the front housing 18, the front insulator 20 has a hollow cylindrical configuration which is open at its front and rear ends, which correspond to the front and rear ends 26, 27 of the front housing. A base insulator 24 which also has a hollow configuration is disposed within the base housing 22.

In particular, the base insulator 24 has a cylindrical central bore 25 which when it is arranged in the central bore 32 of the base housing 22 extends from an open end at the open terminating or mounting end 28 of the base housing to an open end at the open front end 29 of the base housing 22. Thus, the front and base insulators 20, 24 define a continuous cylindrical bore which extends along a right angle path through the housing from the mating end 26 to the terminating or mounting end 28. The front and base insulators 20, 24 may be constructed of a suitable insulating material which can be a plastic material, such as, TEFLON® or the like. However, the insulators could also be constructed of polymethylpentene material which provides superior electrical performance without the cold flow and puncture damage associated with teflon insulators.

Figure 4:
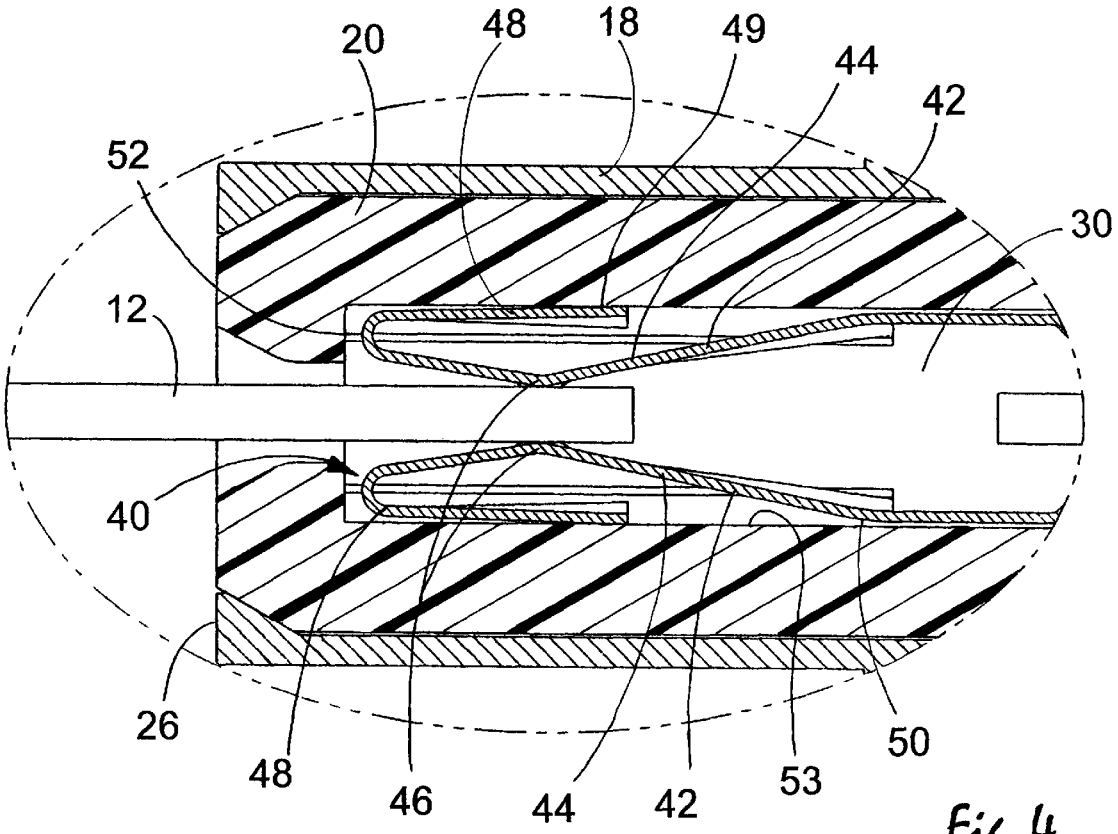
FIG. 4 is a partial top sectional view of the coaxial connector of FIG. 1 showing a center contact constructed in accordance with the teachings of the present invention mated to a center conductor of a coaxial cable.

In order to provide the mechanical and electrical connection with the central conductor pin of the mating male connector, the coaxial connector 10 includes a central female contact member 30. In particular, when the coaxial connector 10 is joined with the mating male connector 14, the center conductor pin 12 of the male connector extends through the open front mating ends of the front housing 18 and front insulator 20 and into the insulator as best shown in FIG. 4. Inside the front housing and insulator, the center conductor pin 12 mates with a generally cylindrical female contact member 30 disposed in the central bore 21 in the front insulator. Specifically, as best shown in FIGS. 8–13, the female contact member 30 has a unique configuration which generally comprises a cylindrical outer surface 38 which defines an open front mating end 40 for receiving the male center pin 12 and includes two double bellows spring portions 42 which extend inwardly from the outer surface 38 on opposite sides of the cylinder. The "double-bellows" female contact member 30 is stamped and formed out of a copper alloy material.

Each double bellows spring portion 42 includes a bowed portion 44 which extends through an apex 46 towards the mating end 40 of the contact member where the spring portion is bent outwardly and back upon itself. This bowed portion 44 and bent-back portion 48 essentially define a three-piece spring. As such, a spring force in the normal direction (i.e. force in the direction perpendicular to the axis of the center conductor pin 12) is generated at three different locations within the respective double bellows spring portions 42. In particular, a first spring force is generated at the point, generally referenced as 50 in FIGS. 4 and 10, where the bowed portion 44 first begins to extend inwardly from the outer surface 38 of the female contact member. A second spring force in the normal direction is generated at the transition bend, generally referenced as 52 in FIGS. 4 and 10, between the bowed portion 44 and the bent back portion 48. The third spring force in the normal direction is generated at the end 49 of the bent back portion 48 where the bent back portion engages the inner wall 53 of center bore 21 in the front insulator 20 as shown FIG. 4.

Figure 5:
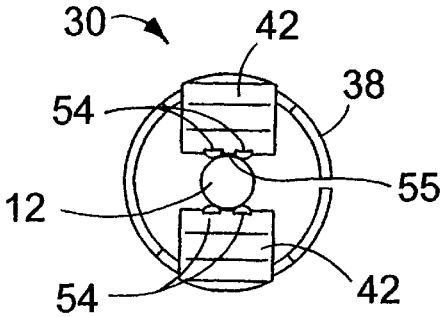
FIG. 5 is a partial end view of the mated center contact and center conductor shown in FIG. 4.
Figure 6:
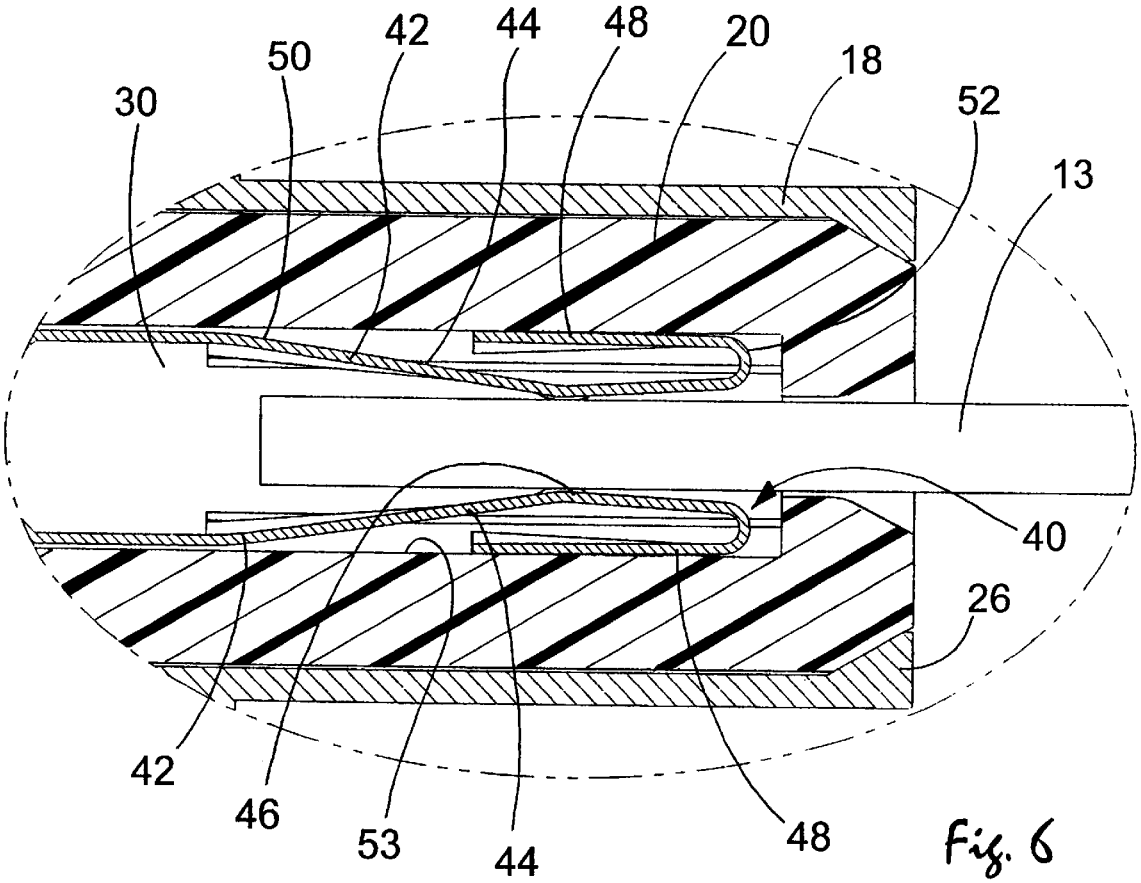
FIG. 6 is a partial top sectional view of the coaxial connector of FIG. 1 showing the center contact mated to a relatively larger diameter center conductor as compared to that shown in FIG. 4.
Figure 7:
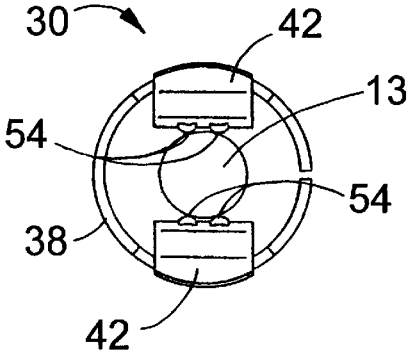
FIG. 7 is a partial end view of the mated center contact and center conductor shown in FIG. 6.
Figure 8:
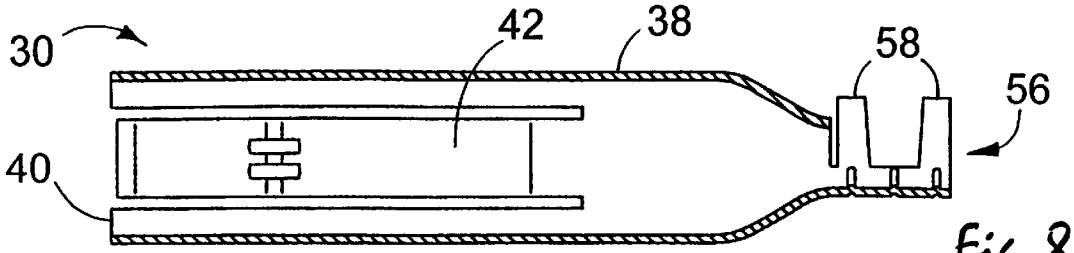
FIG. 8 is a side sectional view of the center contact.
Figure 9:
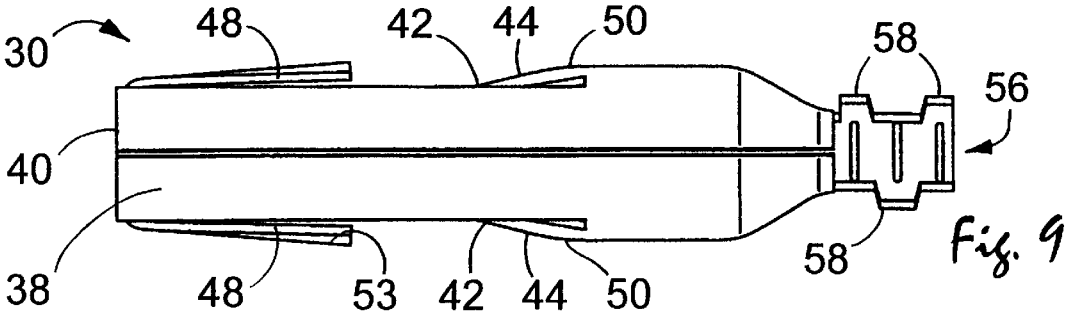
FIG. 9 is a top view of the center contact.
Figure 10:
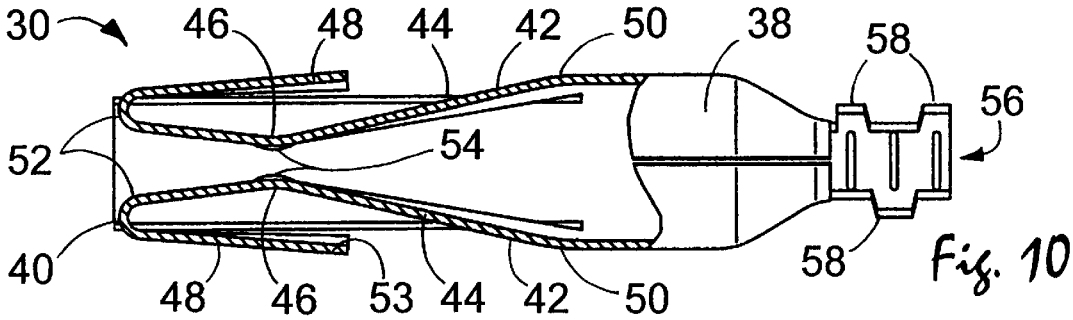
FIG. 10 is a partially cut away top view of the center contact.
Figure 11:
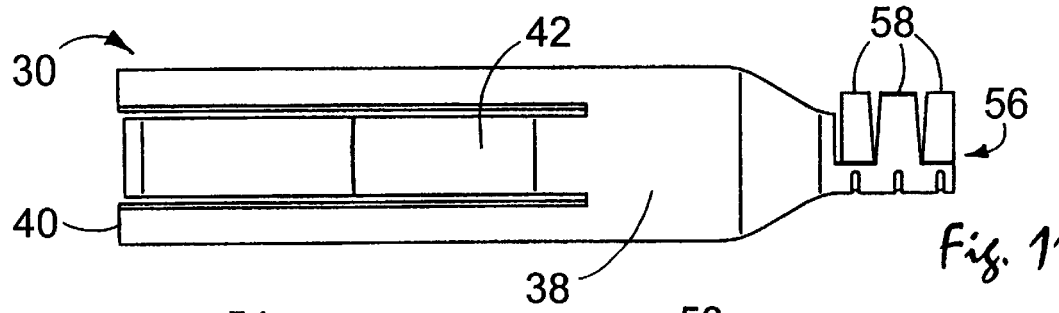
FIG. 11 is a side view of the center contact.
Figure 12:
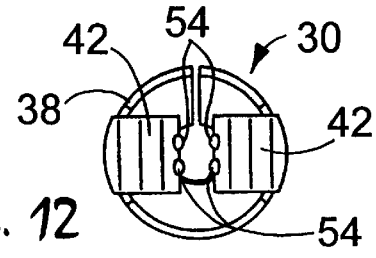
FIG. 12 is a front end view of the center contact.
Figure 13:
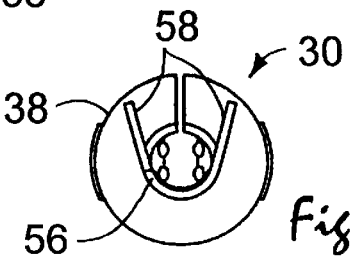
FIG. 13 is a rear end view of the center contact.

The unique configuration of the double bellows spring portions 42 enable the female contact member 30 to achieve a high normal or contact force while only requiring a relatively small force to insert and withdraw the center conductor pin 12 from the female contact member. In addition, as illustrated in FIGS. 4–7, the configuration of the double bellows spring portions 42 allow sufficient deflection to enable the female contact member 30 to mate with center conductor pins 12, 13 having a range of diameters. In one preferred embodiment, the female contact member 30 can mate with center conductor pins 12, 13 from 0.0317 inches in diameter to 0.0513 inches in diameter. Moreover, the configuration of the double bellows spring portions 42 enable them to deflect without any stress relaxation. Accordingly, the female contact member 30 can mate reliably with a relatively small diameter center pin 12, such as shown in FIGS. 4–5, after mating with a relatively large diameter center pin 13, such as shown in FIGS. 6–7.

In order to concentrate or focus the contact force provided by the double bellows spring portions 42, a pair of raised protrusions or bumps 54 are arranged on the apex 46 of the bowed portion 44 of each double bellows spring portion. As best shown in FIG. 5, when the coaxial connector 10 is joined to a mating connector 14, the raised bumps 54 comprise the mating surfaces which engage the surface of the center pin 12 and establish the electrical contact between the male center pin and the female contact member 30. The engagement of the raised bumps 54 with the male center pin 12 provides a gas-tight seal which ensures that a reliable long-term electrical connection is established between the female connector member 30 and conventional male coaxial connectors having copper or copper clad steel center conductor pins 12. Particularly, in a long-term connection between the female contact member 30 and a male center pin 12, this gas tight seal prevents oxidization of the center pin and corrosion or corrosion by-products from forming on the center conductor pin, all of which could result in a degraded signal.

The raised bumps 54 also provide several other significant advantages which enhance the electrical performance of the coaxial connector of the present invention at high frequencies. For example, as shown in FIG. 5, the raised bumps 54 lift the center pin 12 such that it does not actually engage the surface 55 of the apex 46 of the bowed portions 44 of the respective bellows spring portions. If the center pin 12 were allowed to engage the surface of the bowed portions, over time, a groove would form in the surface 55 of the apex 46 which may lessen the effective contact area between the center pin 12 and the female contact member 30, and lead to a degradation of the signal. In addition, as the center pin 12 is axially inserted into the female contact member 30, the raised bumps 54 act to scrape off any corrosion which may have formed on the center pin.

The high frequency electrical performance of the female contact member 30 can be further enhanced by gold-plating the mating surfaces of the coaxial connector 10, which in the illustrated embodiment comprises the raised bumps 54. Gold does not react with conventional copper or copper clad steel center conductors, therefore the gold plating of the mating surfaces reduces signal intermodulation caused by dissimilar metals.

Referring to FIGS. 2–3, a terminating portion 56 adapted for connection to a contact tail 60, is provided on the end opposite the mating end 40 of the female contact member 30. As shown in FIGS. 8–11 and 13, the terminating portion 56 includes three upstanding tabs 58 which can be crimped over the contact tail 60 to secure the contact tail to the female contact member 30. As shown in FIGS. 1 and 3 the contact tail 60 extends through the bore 25 in the base insulator and out the open terminating or mounting end 28 of the base housing 22. In order to complete the electrical connection, the exposed end of the contact tail 60 can be soldered or otherwise connected to an electrical device such as the illustrated printed circuit board 16. The surfaces of the terminating portion 56 of the female contact member 30 are tin/lead plated in order to provide better high frequency performance.

In accordance with another important aspect of the present invention, the individual components are configured so as to ensure that the female coaxial connector 10 matches the characteristic impedance of the coaxial cable, e.g. 75 ohms for conventional coaxial cables providing cable television service. At the higher frequencies which will be associated with cable systems which transmit voice and data signals in addition to video signals, current concentrates at the outer surface of the coaxial cable center conductor. Accordingly, the female contact member 30 has a generally cylindrical shape in order to provide an impedance match. In addition, the insulators 20, 24 and the housings 18, 22 also have cylindrical configurations which, in combination with the female contact member 30 and contact tail 60, simulate a "coaxial" configuration across the connector 10 and thereby help match the characteristic impedance of the coaxial cable. In the embodiment illustrated in FIGS. 113, the right angle bend of the central bore 32 in the base housing is kept constant (best shown in FIG. 3) to help ensure the impedance match. The cylindrical configuration of the insulators 20, 24 and the housings 18, 22 also help prevent reflections which could degrade the signal. Accordingly, the "coaxial" configuration of the insulators, housings and the female contact member along with the selection of materials and the plating of the mating and terminating surfaces all contribute to the superior high frequency performance (e.g. low signal loss) of the female coaxial connector of the present invention as compared to conventional coaxial connectors.

Figure 14:
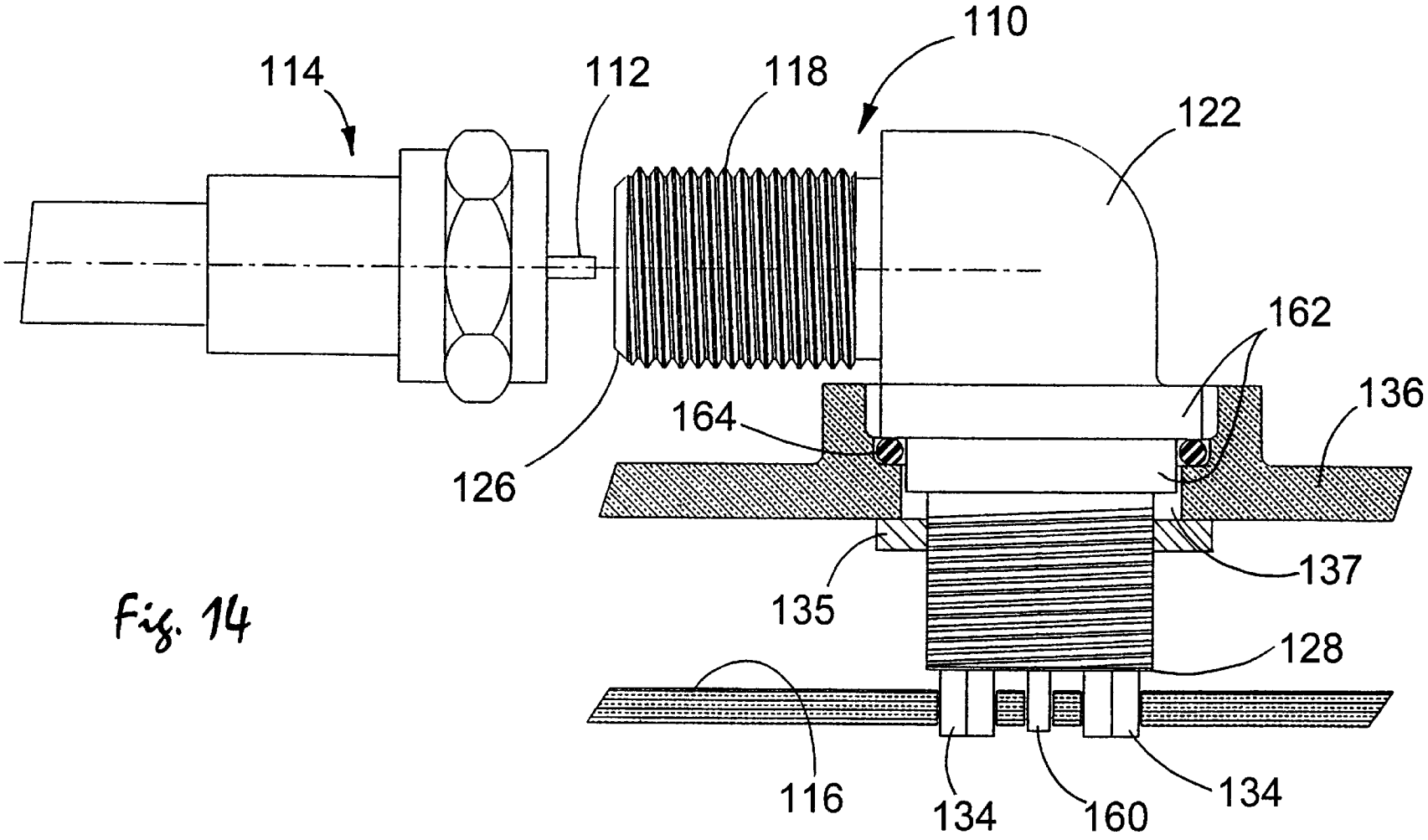
FIG. 14 is a side view of another embodiment of a coaxial connector constructed in accordance with the teachings of the present invention and a mating coaxial connector.
Figure 15:
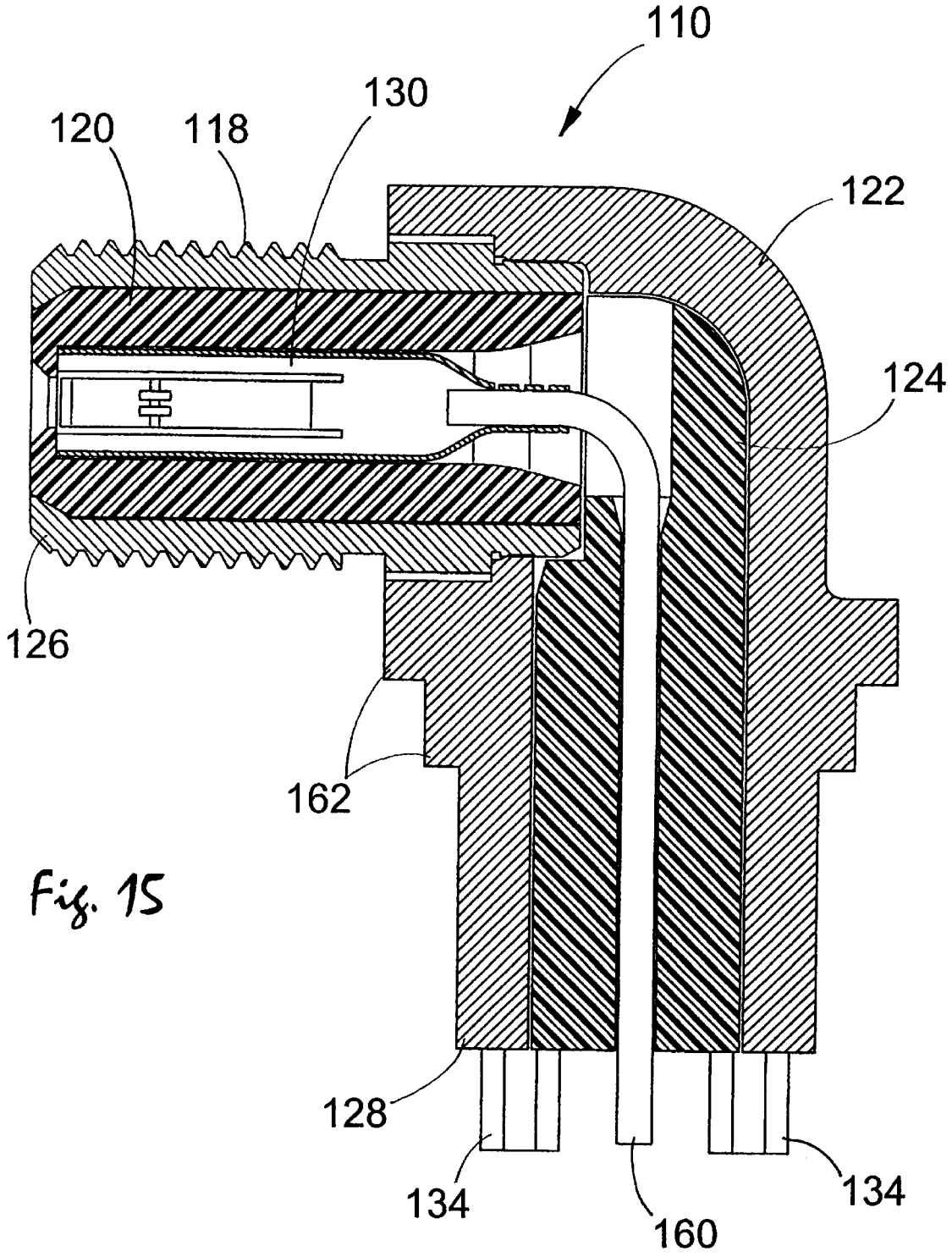
FIG. 15 is a side sectional view of the coaxial connector of FIG. 14.
Figure 16:
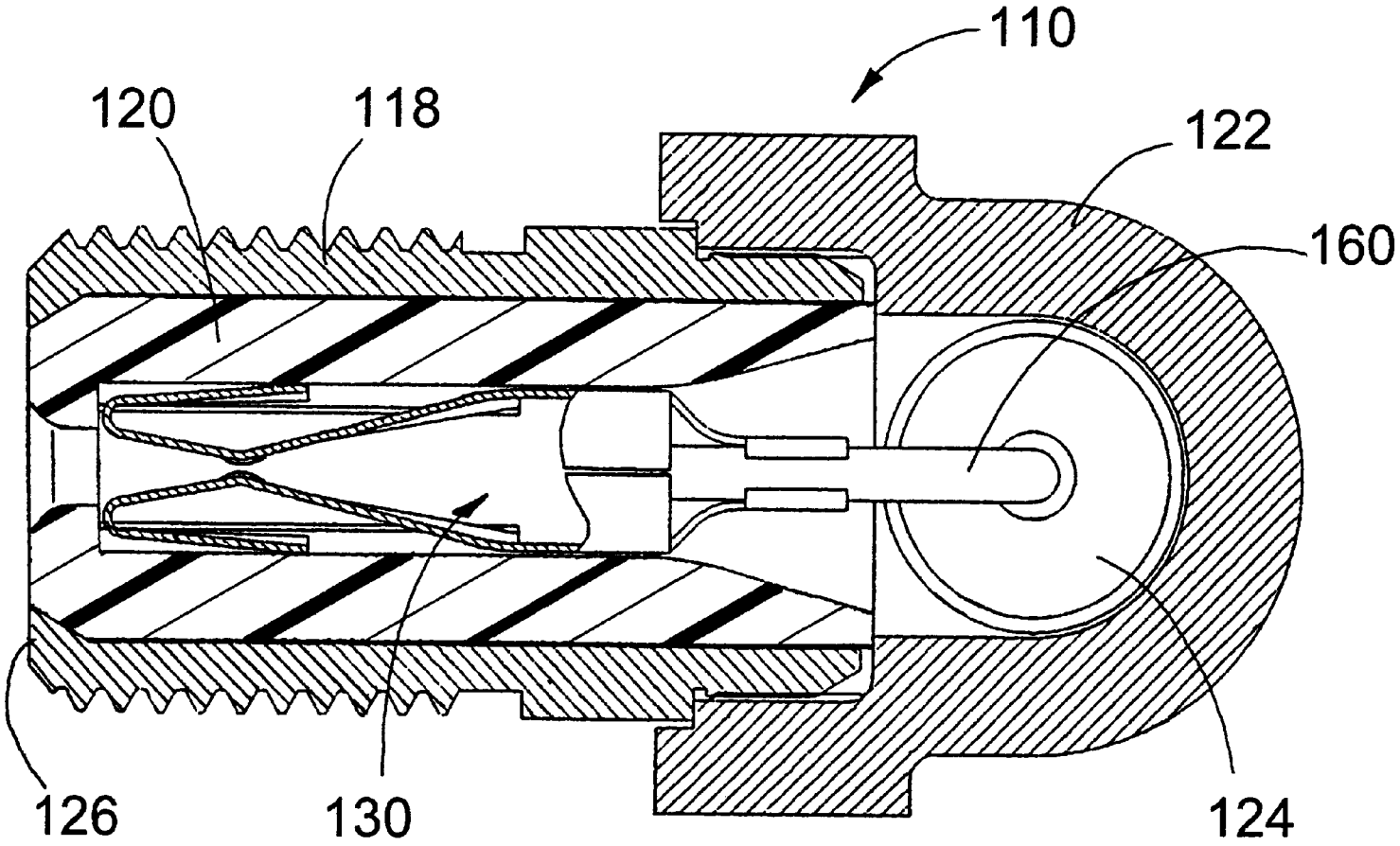
FIG. 16 is a top sectional view of the coaxial connector of FIG. 14.

Referring to FIGS. 14–16, there is shown a second embodiment of a female coaxial connector 110 constructed in accordance with the present invention. The coaxial connector 110 is nearly identical to the first embodiment in all respects, and has similar reference numerals, except the base housing 122 is adapted such the connector can be used in a different installation arrangement than the first embodiment. Specifically, as shown in FIG. 14, the coaxial connector 110 is configured as a right angle threaded connector. The threaded connector may be installed in an equipment housing 136 with the lower half of the right angle base housing 122 extending through an opening 137 in the equipment housing. In order to secure the connector 110 to equipment housing 136, the opening 137 may be threaded or a nut 135 could be provided on the threaded portion of the base housing 122 as shown in FIG. 14. To facilitate engagement of the base housing 122 with the equipment housing 136, the lower end of the base housing is threaded and the exterior surface of the right angle base housing 122 includes a series of stepped flanges 162 which engage the equipment housing 136 and hold the coaxial connector 110 in the proper position. An O-ring 164 may be provided between the flanges 162 on the right angle base housing 122 and the equipment housing 136 in order to enhance the seal therebetween.

Figure 17:
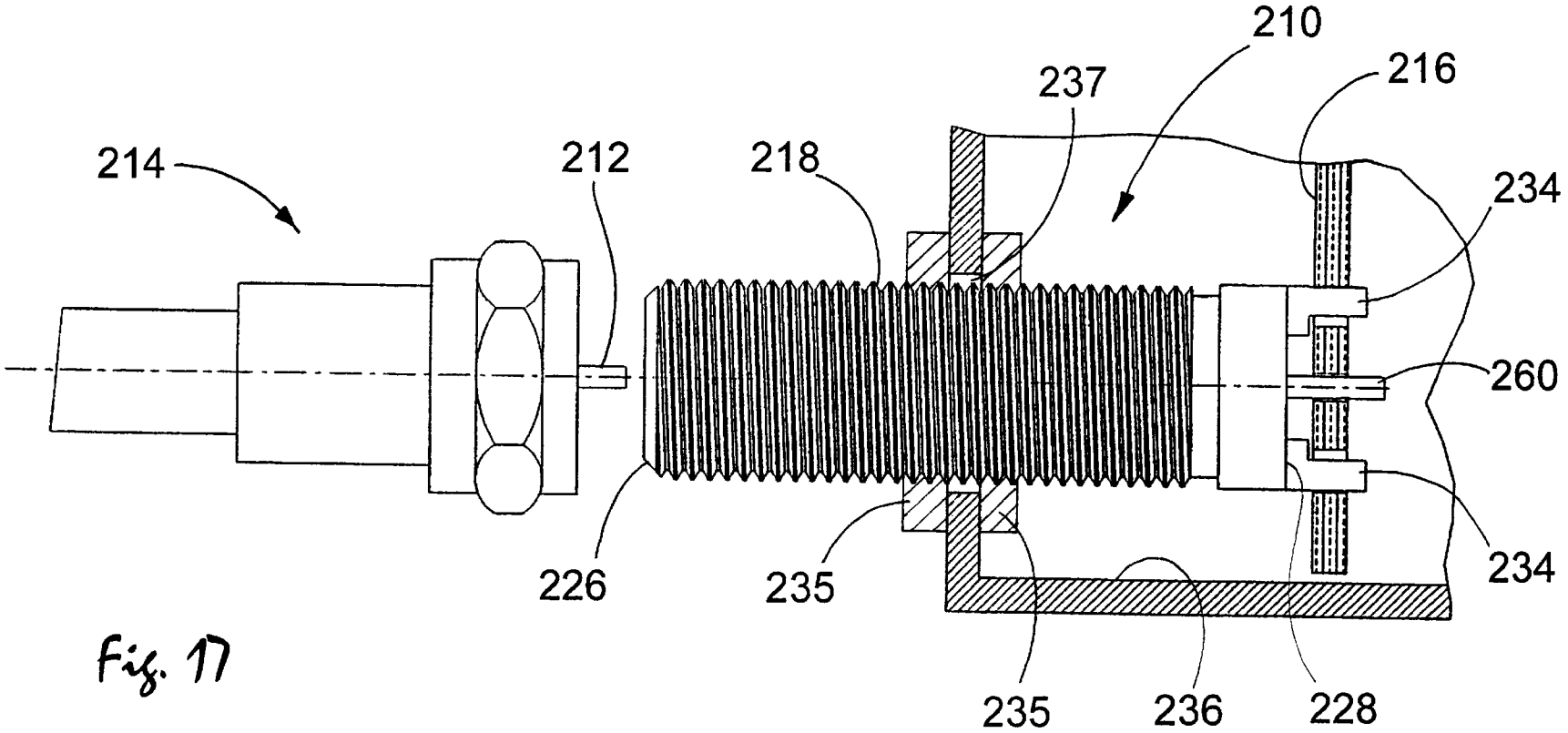
FIG. 17 is a side view of another embodiment of a coaxial connector constructed in accordance with the teachings of the present invention and a mating connector.
Figure 18:
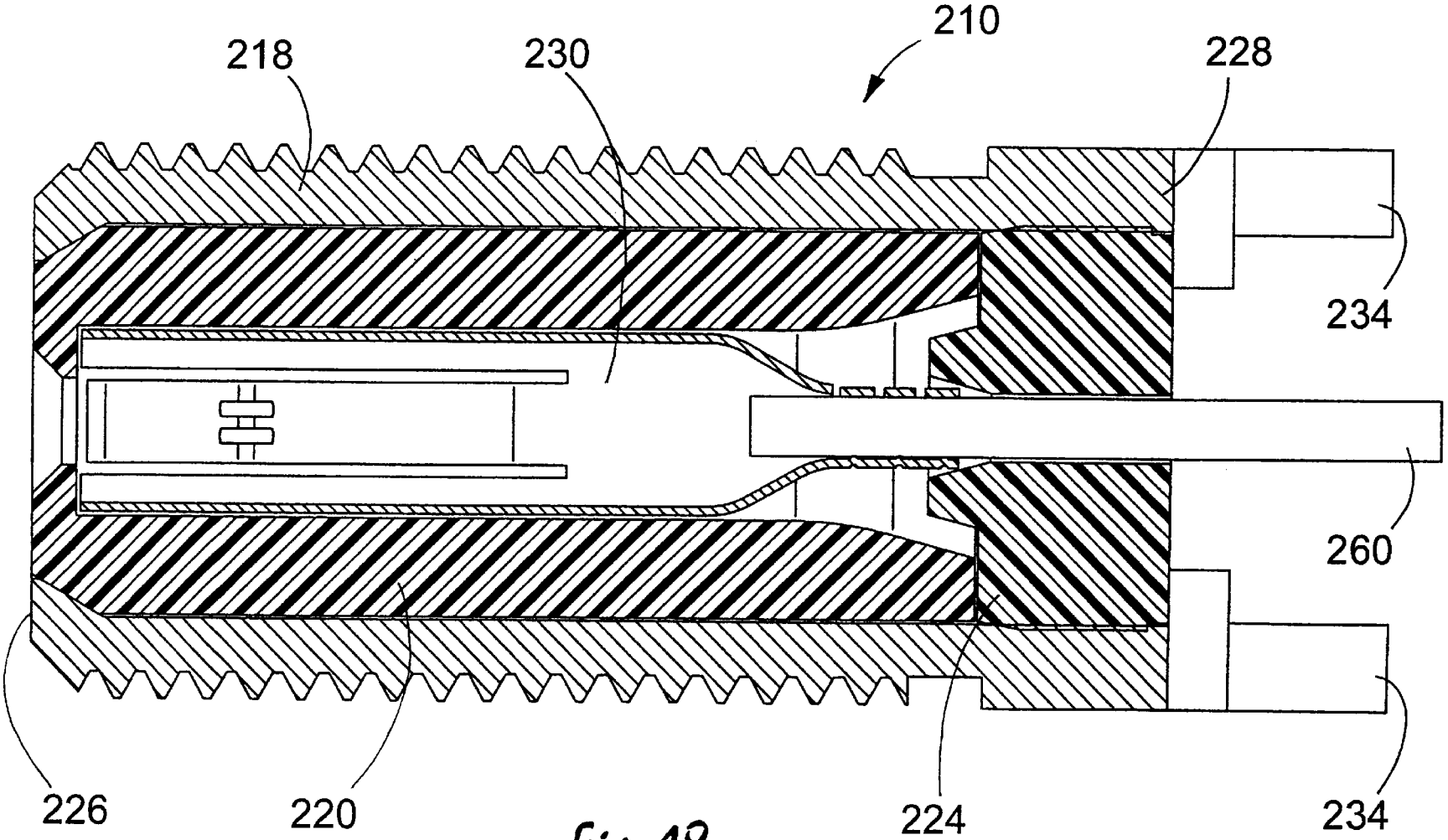
FIG. 18 is a side sectional view of the coaxial connector of FIG. 17.

A third embodiment of a coaxial connector 210 constructed in accordance with the present invention is shown in FIGS. 17–18. In this embodiment, the coaxial connector 210 is configured as a straight terminating connector. Unlike the embodiments shown in FIGS. 1–16, the coaxial connector 210 has a generally cylindrical one-piece housing 218 which can be arranged such that the front or mating portion 226 of the housing extends outwardly through an opening 237 in an equipment housing 236 for connection to a mating connector 214 as shown in FIG. 17. As with the first and second embodiments, the mating end 226 of the housing is threaded and the terminating end 228 includes grounding legs 234 which can be attached by solder or other suitable means to an electrical device such as a circuit board 216. In addition, as with the other embodiments, the coaxial connector 210 includes a front insulator 220, a base insulator 224, a double bellows female center contact member 230 arranged in the front insulator and a contact tail 260 joined to the female contact member and extending through the open terminating end 228 of the housing. In order to secure the connector 210 to the equipment housing 236, the opening 237 may be threaded and/or one or more nuts 235 may be provided on one or both sides of the equipment housing as shown in FIG. 17.

Figure 19:
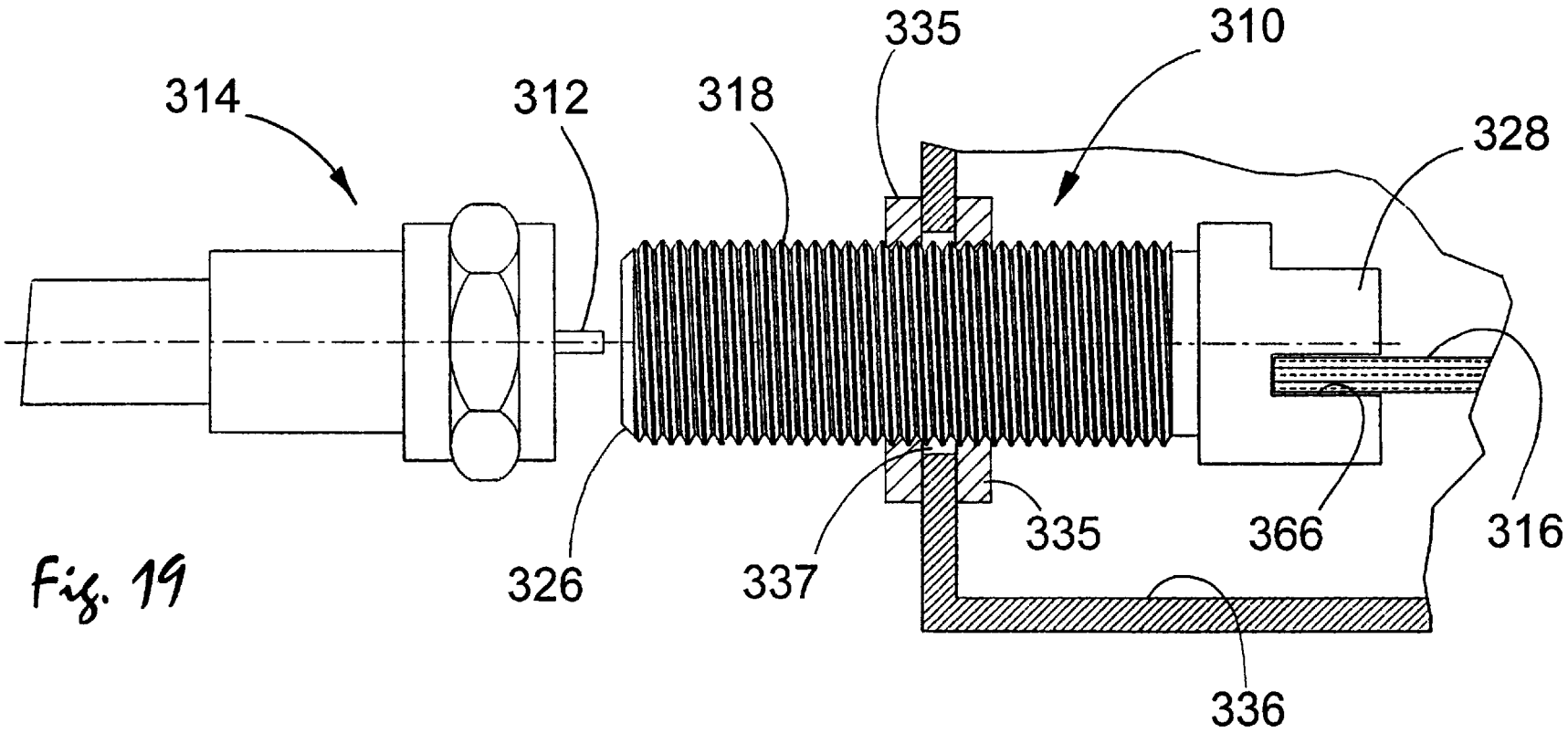
FIG. 19 is a side view of another embodiment of a coaxial connector constructed in accordance with the teachings of the present invention and a mating connector.
Figure 20:
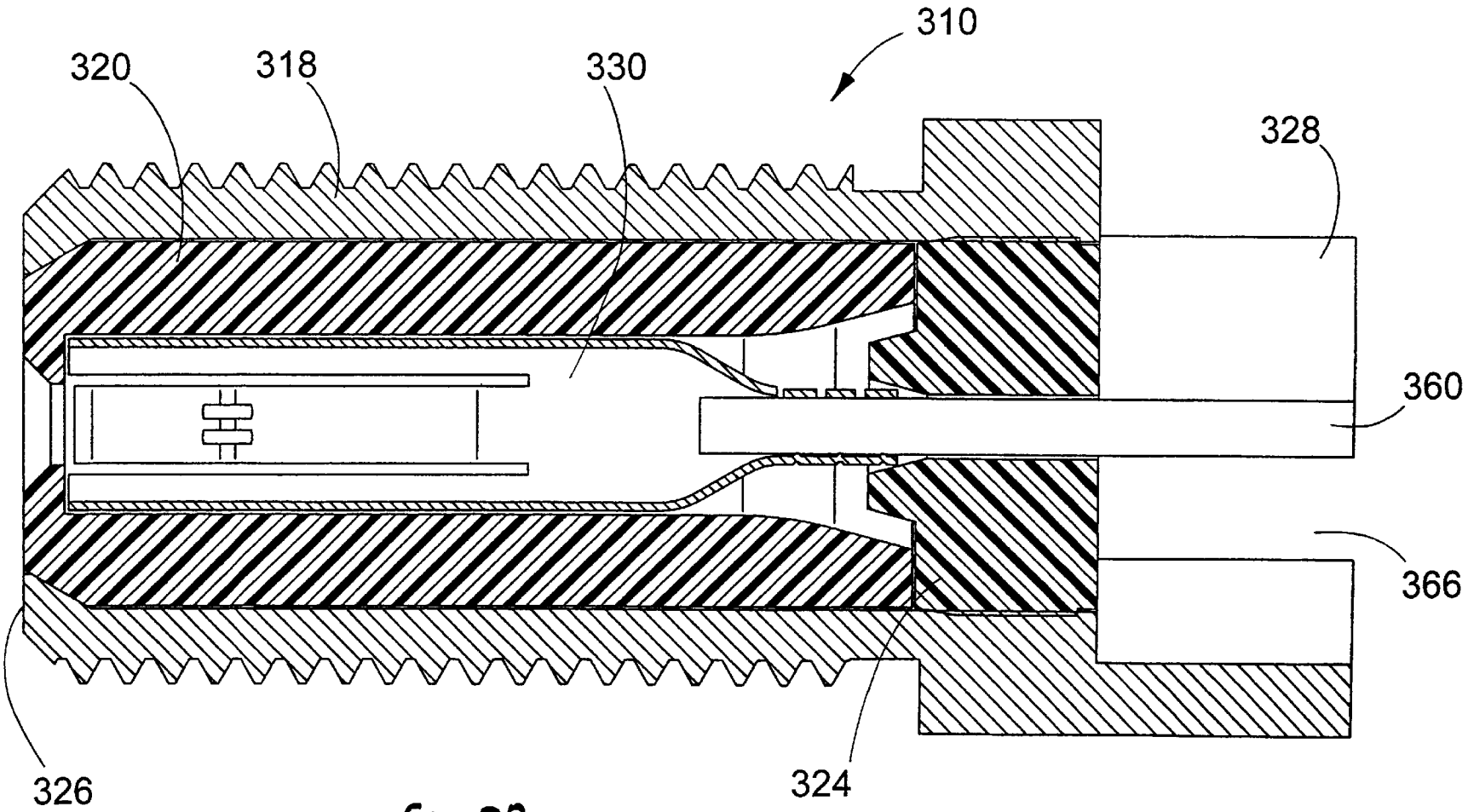
FIG. 20 is a side sectional view of the coaxial connector of FIG. 19.

Referring to FIGS. 19–20, a fourth embodiment of a coaxial connector 310 constructed in accordance with the teachings of the present invention is shown. In the FIGS. 19–20 embodiment, the coaxial connector 310 is configured for edge termination or mounting. The coaxial connector 310 is the same as the embodiment shown in FIGS. 17–18 in all respects except that the terminating or mounting end 328 of the housing is specifically adapted to facilitate terminating the coaxial connector 310 to the edge of a circuit board 316. Specifically, instead of mounting legs, the coaxial connector 310 includes a slot 366 which can be placed over the edge of a circuit board 316 as shown in FIG. 19. The slot 366 holds the coaxial connector 310 in the proper position while the contact tail 360 (best shown in FIG. 20) is soldered to the circuit board 316. The use of the slot 366 to hold the coaxial connector 310 in the proper position eliminates the need for an assembler to physically hold the connector 310 during the assembly operation. Thus, the slot 366 allows the assembler to use both hands to perform the soldering operation. In addition, as with the embodiment shown in FIGS. 17–18, the connector 310 may be secured to the housing by threading the opening 337 and/or providing one or more nuts 335 on one or both sides of the housing 336 as shown in FIG. 19.

Figure 21:
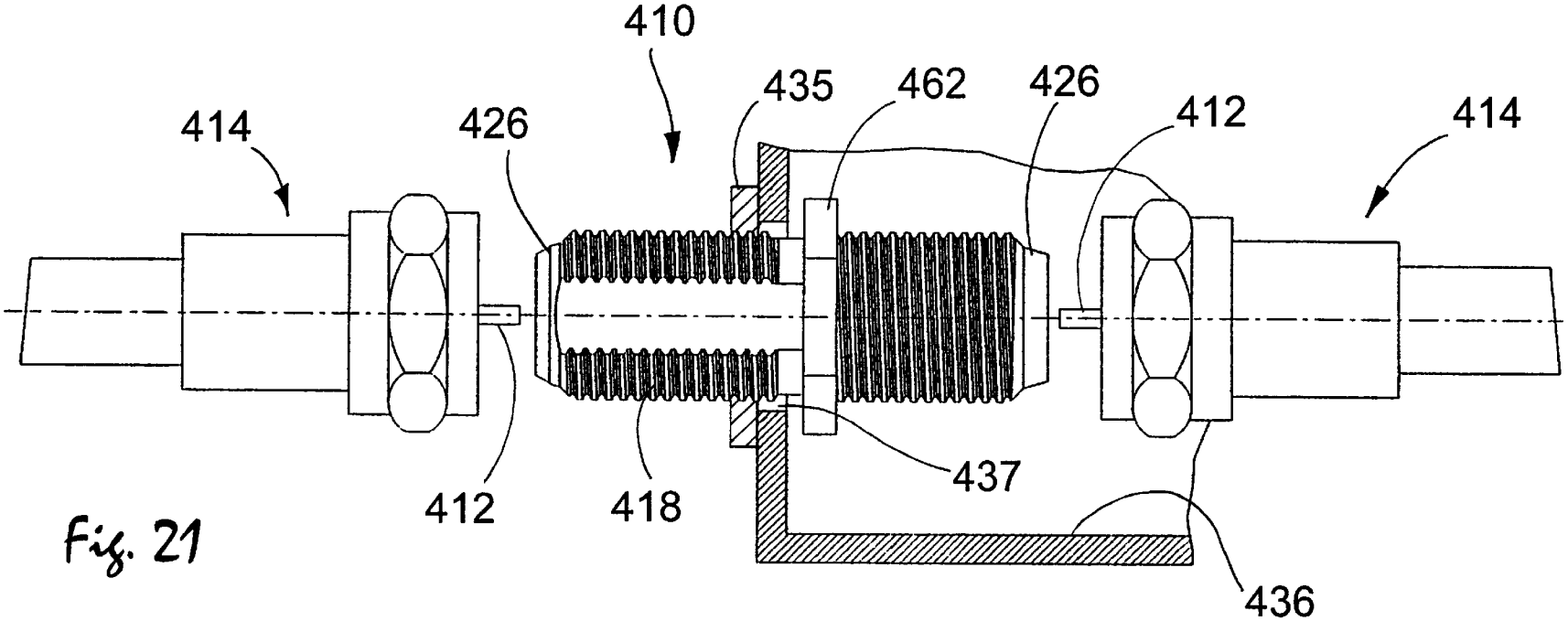
FIG. 21 is a side view of yet another embodiment of a coaxial connector constructed in accordance with the teachings of the present invention and a pair of mating connectors.
Figure 22:
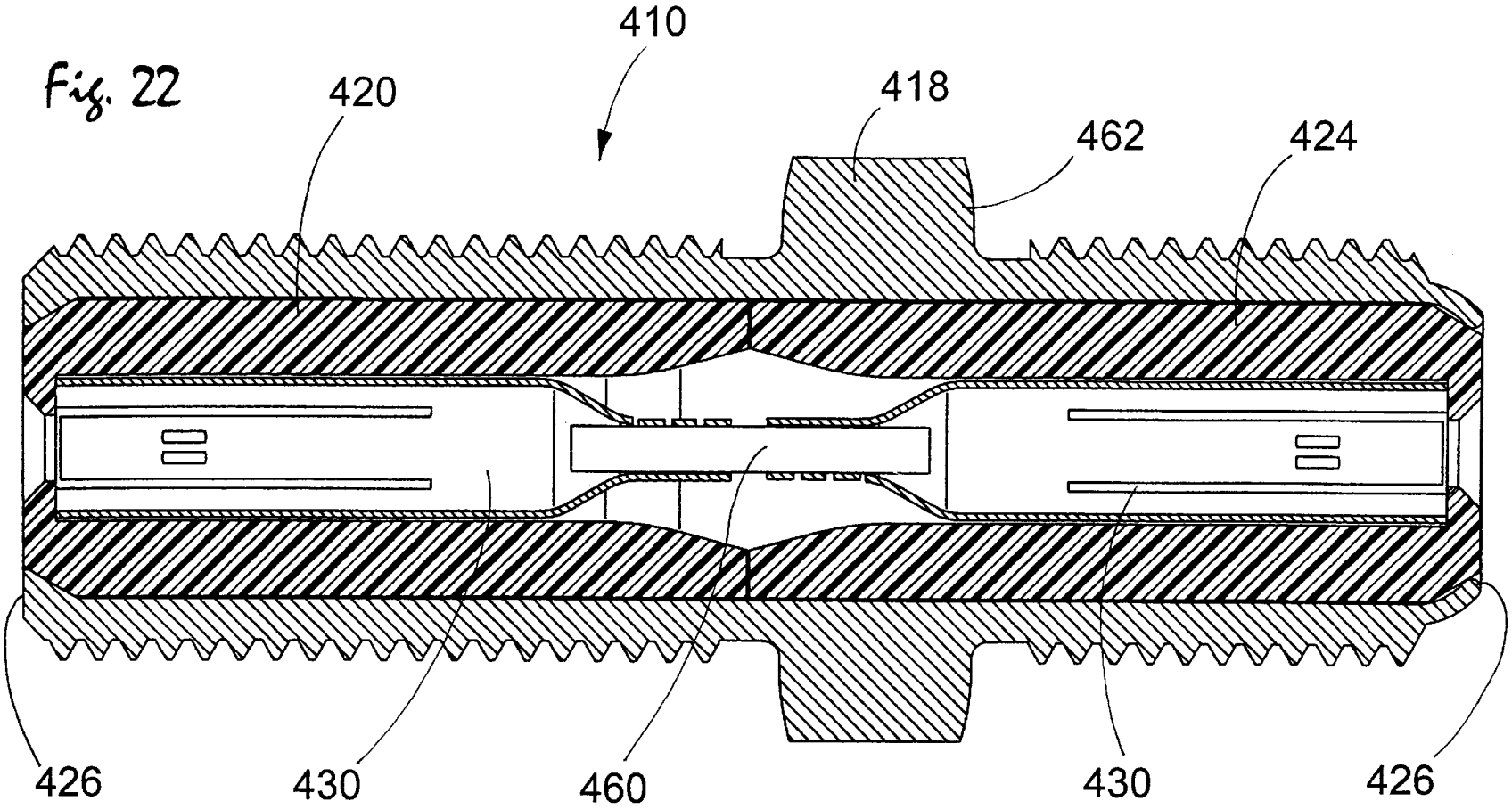
FIG. 22 is a side sectional view of the coaxial connector of FIG. 21.

A fifth embodiment of a coaxial connector 410 constructed in accordance with the teachings of the present invention is shown in FIGS. 21–22. In the embodiment shown in FIGS. 21–22, the coaxial connector 410 is configured as a female-to-female adapter. Particularly, the connector 410 includes a one-piece housing 418 that has a pair of threaded mating ends 426 which are adapted for connection to mating male coaxial connectors 414 and are separated by a flange 462. One possible installation arrangement for the coaxial connector 410 is illustrated in FIG. 21. In this arrangement, the coaxial connector 410 may be installed with one of the mating ends 426 extending through an opening 437 in an equipment housing 436. As shown in FIG. 22, the coaxial connector 410 includes a pair of hollow cylindrical insulators 420, 424 arranged in the housing each of which has a double bellows female contact member 430 arranged in the respective central bore. The two female contact members 430 are joined by a single contact tail 460 which extends between the terminating ends 456 of the respective female contact members. In order to secure the connector 410 to the housing 436, the opening 437 may be threaded and/or a nut 435 may be provided as shown in FIG. 21.

Figure 23:
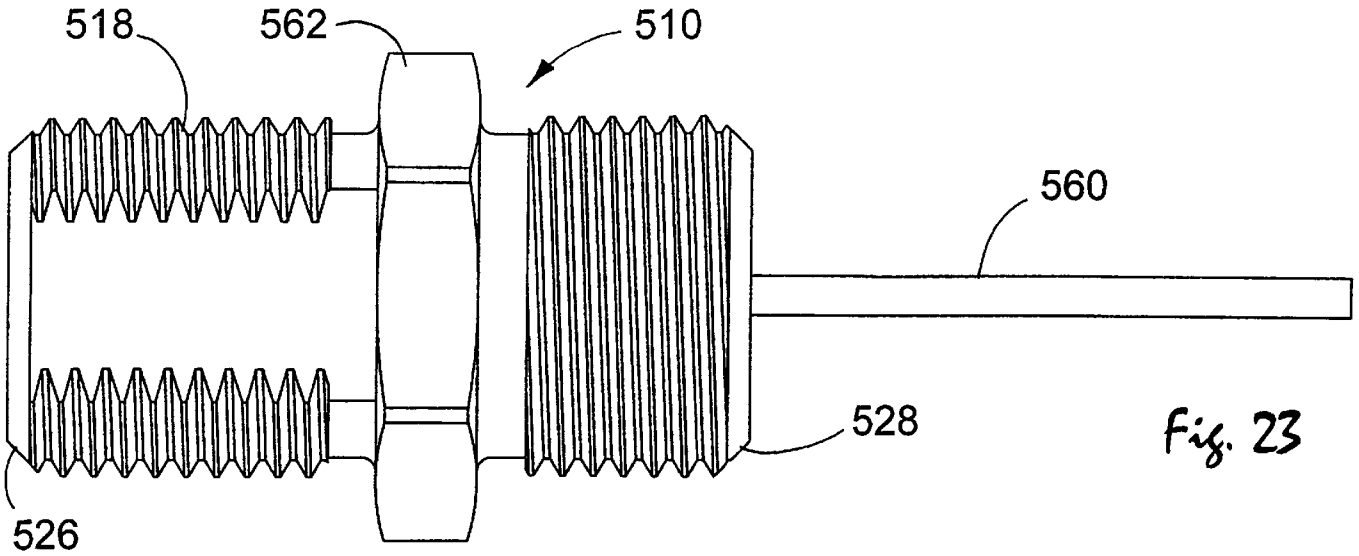
FIG. 23 is a side view of another embodiment of a coaxial connector constructed in accordance with the teachings of the present invention.
Figure 24:
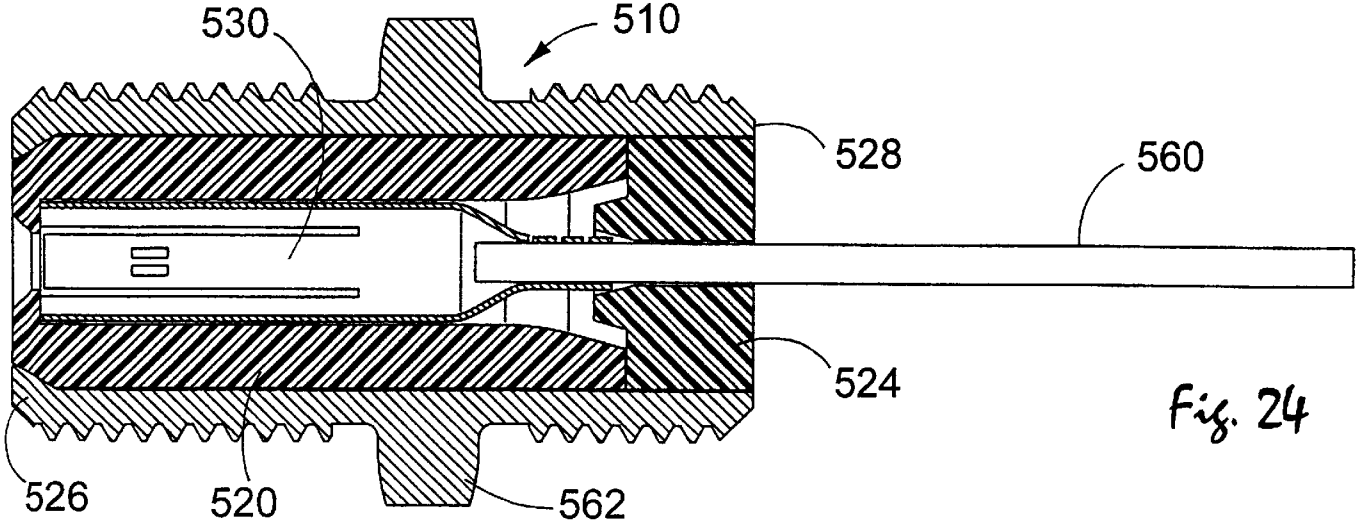
FIG. 24 is a side sectional view of the coaxial connector of FIG. 23.

A sixth embodiment of a coaxial connector 510 constructed in accordance with the present invention is shown in FIGS. 23–24. The coaxial connector 510 is similar to the straight terminating embodiment shown in FIGS. 17–18, however, instead of being configured with mounting posts, the terminating end 528 of the one-piece housing is threaded. In addition, a flange 562 on the housing 518 is provided which separates the mating and terminating ends 526, 528 of the housing. As shown in FIG. 24, like the previous embodiments, the coaxial connector 510 includes two hollow cylindrical insulators 520, 524 arranged in the hollow central bore of the housing 518 and a double bellows female contact member 530. A contact tail 560 is also provided which extends out of the open terminating end of the housing for termination, via solder or other suitable means, to an another coaxial connector or an electrical device such as a circuit board.

Figure 25:
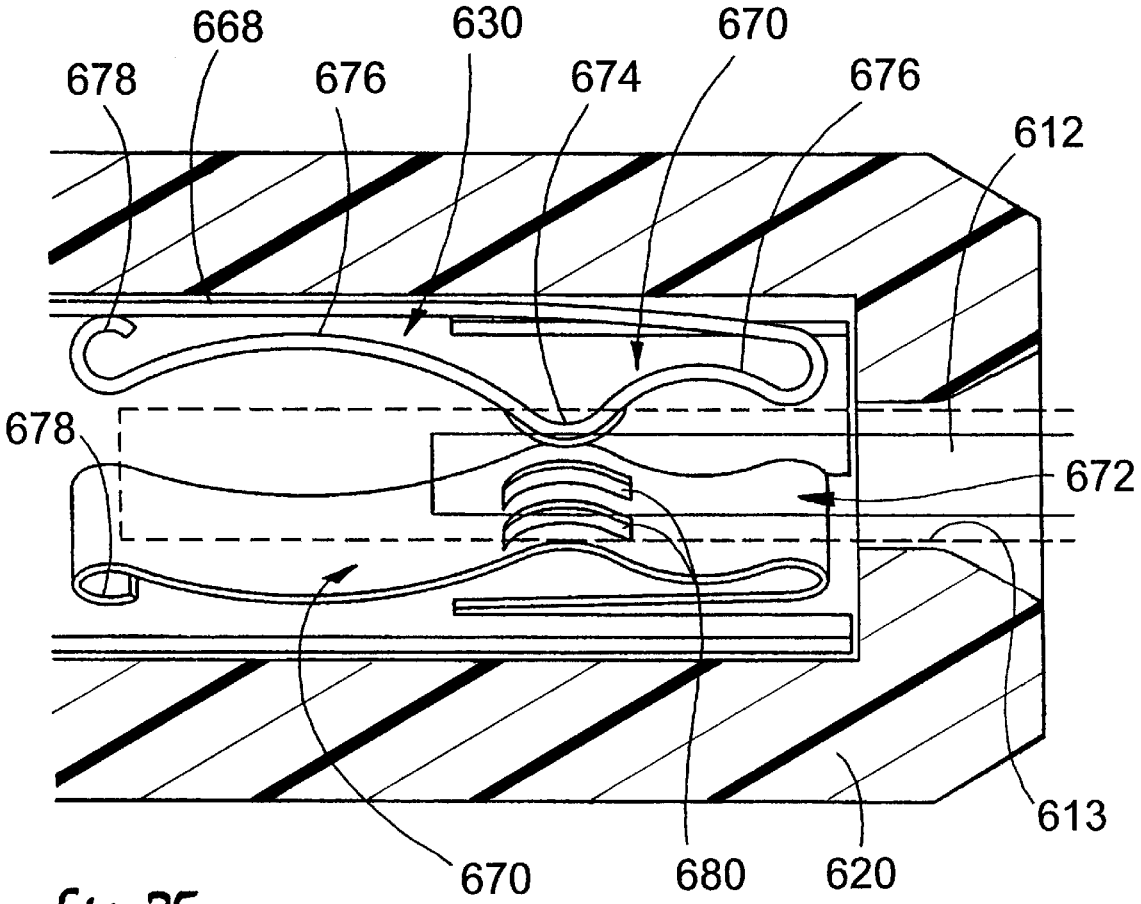
FIG. 25 is a side sectional view showing another embodiment of a center contact constructed in accordance with the teachings of the present invention.
Figure 26:
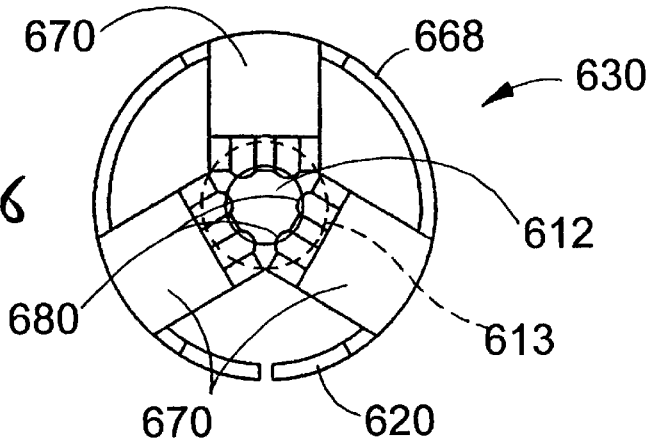
FIG. 26 is an end view of the center contact of FIG. 25.

Another configuration of a center female contact member 630 is shown in FIGS. 25 and 26. The female contact member 630 is shown arranged in the central bore of an insulator member 620. The contact member 630 comprises a generally cylindrical outer surface 668 which has three inwardly extending resilient ribbon shaped spring portions 670 which define an open mating end 672 which is adapted to receive the center conductor pin 612 of a mating male coaxial connector. The contact member 630 also includes a terminating end which is adapted to receive a contact tail. As shown in FIG. 26, the ribbon spring portions 670 are arranged equidistant from one another around the inner circumference of the contact member. Each ribbon spring portion 670 is folded inwardly and back adjacent the mating end 672 of the contact to form an inwardly bowed contact surface 674 which is separated by a pair of outwardly bowed portions 676. Each ribbon spring portion 670 extends to a curled end 678 which bears against the inside of the outer surface 668 of the contact member 630. In addition, the apex of the inward bowed portion 674 of each of the ribbon springs 670 includes a pair of raised bumps 680. The ribbon spring portions 670 are adapted such that the female contact member 630 can mate reliably with center conductor pins 612 of different diameter. In FIGS. 25–26, a relatively small diameter center conductor pin 612 is shown in solid lines and a relatively large diameter center conductor pin 613 is shown in broken lines. The contact member 630 may be formed by stamping.

While this invention has been described with an emphasis upon certain embodiments, it will be obvious to those of ordinary skill in the art that variations of these embodiments may be used and that it is intended that the invention may be practiced otherwise than as specifically described herein. Accordingly, this invention includes all modifications encompassed within the spirit and the scope of the invention as defined by the following claims.

What is claimed is:

1. A coaxial connector for interconnecting a coaxial conductor to an electrical device or to a second coaxial conductor, the coaxial connector comprising:

a housing having a mating end and a mounting end and a passage therethrough extending from the mating end to the mounting end;

an insulator having a opening therethrough and arranged in the housing such that the insulator bore extends from the mating end to the mounting end of the housing;

a contact member arranged in the insulator bore and including a mating end for receiving the coaxial conductor, the contact member having an outer surface and a plurality of resilient spring portions extending inwardly from the outer surface and spaced from each other around the circumference of the outer surface of the contact member, the resilient spring portions producing a contact force when they are deflected outwardly upon receiving the coaxial conductor; and a raised bump arranged on one of the resilient spring portions such that upon receiving the coaxial conductor the raised bump engages the coaxial conductor and establishes electrical contact between the coaxial conductor and the contact member and focuses the contact force provided by said one resilient spring portion.

2. The invention as in claim 1 wherein the mounting end of the housing includes a plurality of grounding legs.

3. The invention as in claim 1 wherein the housing has a right angle configuration.

4. The invention as in claim 3 wherein the housing includes a front housing having a passage therethrough and a base housing having a right angle passage therethrough.

5. The invention as in claim 4 wherein the insulator includes a front insulator arranged in the front housing and a base insulator arranged in the base housing.

6. The invention as in claim 1 wherein the mounting end of the housing is configured for connection to a circuit board.

7. The invention as in claim 6 wherein the mounting end of the housing is configured for connection to the edge of a circuit board.

8. The invention as in claim 7 wherein the mounting end of the housing includes a slot adapted to engage the edge of a circuit board.

9. The invention as in claim 1 wherein the mounting end of the housing is configured to mate with a second coaxial conductor.

10. The invention as in claim 1 wherein the contact member includes a termination end which is adapted for receiving a contact tail.

11. The invention as in claim 10 further including a contact tail terminated in the termination end and extending through the insulator bore and out the mounting end of the housing.

12. The invention as in claim 1 wherein a raised bump is arranged on each of the resilient spring portions such that upon receiving the coaxial conductor the raised bump engages the coaxial conductor and establishes electrical connection between the coaxial conductor and the contact member and focuses the contact force provided by the resilient spring portions.

13. The invention as in claim 12 wherein the raised bumps provide a gas tight connection between the contact member and the coaxial conductor.

14. The invention as in claim 1 wherein a pair of raised bumps are arranged on each of the resilient spring portions such that upon receiving the coaxial conductor the raised bumps engage the coaxial conductor and establish electrical connection between the coaxial conductor and the contact member and focus the contact force provided by the resilient spring portions.

15. The invention as in claim 14 wherein the raised bumps are adapted such that when the raised bumps engage the coaxial conductor, the coaxial conductor does not contact the surface of the resilient spring portions.

16. The invention as in claim 1 wherein the housing, insulator and contact member are configured so that the coaxial connector substantially matches the characteristic impedance of the coaxial conductor.

17. The invention as in claim 16 wherein the housing passageway has a cylindrical configuration and the insulator has a hollow cylindrical configuration.

18. The invention as in claim 1 wherein the raised bump is gold plated.

19. The invention as in claim 1 wherein the contact member is stamped and formed from sheet material.

20. The invention as in claim 1 wherein the insulators are constructed of a polymethylpentene material.

21. A coaxial connector for interconnecting a coaxial center conductor to an electrical device or second coaxial conductor, the coaxial connector comprising:

a housing having a mating end and a mounting end and a passage therethrough extending from the mating end to the mounting end;

an insulator having an opening therethrough and arranged in the housing such that the insulator bore extends from the mating end to the terminating end of the housing; and a contact member arranged in the center bore of the insulator and including a mating end for receiving the coaxial center conductor, the contact member having an outer surface and a plurality of resilient spring portions extending inwardly from the outer surface and towards the mating end, the resilient spring members being spaced from each other around the circumference of the outer surface of the contact member;

each of the resilient spring portions being configured as a double bellows spring including a bowed portion extending through an apex to the mating end and a bent-back portion disposed at the mating end and which is bent outwardly and then backwardly upon itself, the apex defining a contact surface which engages the coaxial center conductor.

22. The invention as in claim 21 wherein the spring portions are configured to allow deflection without stress relaxation for mating with coaxial conductors of different diameter.

23. The invention as in claim 21 further including a raised bump on the apex of one of the spring portions such that upon receiving the coaxial conductor the raised bump engages the coaxial conductor and establishes electrical contact between the coaxial conductor and the contact member.

24. The invention as in claim 23 wherein a raised bump is arranged on each of the resilient spring portions for engaging the coaxial conductor to establish the electrical connection between the coaxial conductor and the contact member and for focusing the contact force provided by the resilient spring portions.

25. The invention as in claim 23 wherein a pair of raised bumps are arranged on each of the resilient spring portions such that upon receiving the coaxial conductor the raised bumps engage the coaxial conductor and establish electrical connection between the coaxial conductor and the contact member and focuses the contact force provided by the resilient spring portions.

26. The invention as in claim 25 wherein the raised bumps are adapted such that when the raised bumps engage the coaxial conductor, the coaxial conductor does not contact the apex of the resilient spring portions.

27. The invention as in claim 21 wherein the mounting end of the housing includes a plurality of grounding legs.

28. The invention as in claim 21 wherein the housing has a right angle configuration.

29. The invention as in claim 21 wherein the mounting end of the housing includes a slot adapted to engage the edge of a circuit board.

30. The invention as in claim 21 wherein the contact member includes a termination end and further including a contact tail terminated in the termination end and extending through the insulator bore and out the mounting end of the housing.

31. The invention as in claim 21 wherein the housing, insulator and contact member are configured so that the coaxial connector substantially matches the characteristic impedance of the coaxial conductor.

32. A contact for mating with a coaxial center conductor, the contact comprising:

an outer surface having a mating end for receiving the coaxial conductor and a terminating end, and a plurality of resilient spring members extending inwardly from the outer surface and towards the mating end of the contact, the spring members being spaced from each other around the circumference of the outer surface and each being configured as a double bellows spring which defines a contact surface that engages the coaxial center conductor and is deflectable outwardly upon receiving the coaxial center conductor to produce a contact force at the contact surface.

33. The invention as in claim 32 wherein the spring members are configured to allow deflection without stress relaxation for mating with coaxial conductors of different diameter.

34. The invention as in claim 32 further including a raised bump on the contact surface of one of the respective spring members for engaging the coaxial conductor to establish electrical contact with the coaxial conductor.

35. The invention as in claim 34 wherein a raised bump is arranged on each of the resilient spring members such that upon receiving the coaxial conductor the raised bump engages the coaxial conductor and establishes electrical connection between the coaxial conductor and the contact member and focuses the contact force provided by the resilient spring members.

36. The invention as in claim 34 wherein a pair of raised bumps are arranged on each of the resilient spring members for engaging the coaxial conductor to establish the electrical connection between the coaxial conductor and the contact member and for focusing the contact force provided by the resilient spring members.

37. The invention as in claim 36 wherein the raised bumps are adapted such that when the raised bumps engage the coaxial conductor, the coaxial conductor does not contact the contact surface of the resilient spring members.

38. The invention as in claim 32 wherein the contact member is stamped and formed from sheet material.

39. A contact for mating with a coaxial conductor, the contact comprising:

an outer surface defining a mating end for receiving the coaxial conductor and a terminating end;

a plurality of resilient spring members extending inwardly from the outer surface and spaced from each other around the circumference of the outer surface, the resilient spring members producing a contact force when they are deflected outwardly upon receiving the coaxial conductor; and a raised bump arranged on one of the resilient spring members such that upon receiving the coaxial conductor the raised bump engages the coaxial conductor and establishes electrical contact between the coaxial conductor and the contact member and focuses the contact force provided by said one resilient spring member.

40. The invention as in claim 39 wherein a raised bump is arranged on each of the resilient spring members such that upon receiving the coaxial conductor the raised bumps engage the coaxial conductor and establish electrical connection between the coaxial conductor and the contact member and focus the contact force provided by the resilient spring members.

41. The invention as in claim 40 wherein the raised bumps provide a gas tight connection between the contact member and the coaxial conductor.

42. The invention as in claim 39 wherein a pair of raised bumps are arranged on each of the resilient spring members such that upon receiving the coaxial conductor the raised bumps engage the coaxial conductor and establish electrical connection between the coaxial conductor and the contact member and focus the contact force provided by the resilient spring members.

43. The invention as in claim 42 wherein the raised bumps are adapted such that when the raised bumps engage the coaxial conductor, the coaxial conductor does not contact the surface of the resilient spring members.

44. The invention as in claim 39 wherein the raised bump is gold plated.

* * * * *

UNITED STATES PATENT AND TRADEMARK OFFICE

CERTIFICATE OF CORRECTION

PATENT NO. : 5,971,770
DATED : October 26, 1999
INVENTOR(S) : Richmond

It is certified that error appears in the above-identified patent and that said Letters Patent is hereby corrected as shown below:

In Col. 7, line 15: "FIGS. 113" should read –FIGS. 1-13--

Signed and Sealed this

Sixteenth Day of May, 2000

*Attest:*

Q. TODD DICKINSON

*Attesting Officer*

*Director of Patents and Trademarks*